US009616295B2

(12) United States Patent
Müller

(10) Patent No.: US 9,616,295 B2
(45) Date of Patent: Apr. 11, 2017

(54) CLIMBING DEVICE WITH ANCHORING SURFACE

(71) Applicant: Franz J. Müller, Reichenbach-Steegen (DE)

(72) Inventor: Franz J. Müller, Reichenbach-Steegen (DE)

(73) Assignee: Bahman Azarm, Southport, CT (US)

( * ) Notice: Subject to any disclaimer, the term of this patent is extended or adjusted under 35 U.S.C. 154(b) by 0 days.

(21) Appl. No.: 14/930,847

(22) Filed: Nov. 3, 2015

(65) Prior Publication Data

US 2016/0121169 A1 May 5, 2016

(30) Foreign Application Priority Data

Nov. 4, 2014 (DE) ..... 20 2014 105 291 U

(51) Int. Cl.
*A63B 27/00* (2006.01)
*A63B 69/00* (2006.01)

(52) U.S. Cl.
CPC ..... *A63B 27/00* (2013.01); *A63B 69/0048* (2013.01); *A63B 2209/00* (2013.01)

(58) Field of Classification Search
CPC .. E06C 9/02; E06C 9/04; A63B 27/00; A01M 31/02; F16M 13/022; G09F 2007/1817; G09F 2007/1804
USPC ..... 248/218.4, 219.4; 182/187
See application file for complete search history.

(56) References Cited

U.S. PATENT DOCUMENTS 2,097,562 A * 11/1937 Day ..... A63B 27/00 182/189
2,925,877 A * 2/1960 Wright ..... E06C 7/48 182/108
3,555,747 A * 1/1971 Taylor ..... E04H 12/24 174/45 R
4,601,364 A * 7/1986 York ..... A01M 31/02 108/152
4,699,347 A * 10/1987 Kuhnley ..... A47G 33/1213 248/230.8
4,869,520 A * 9/1989 Cole ..... B60R 3/007 182/127

(Continued)

FOREIGN PATENT DOCUMENTS

EP 1949940 B1 5/2011

*Primary Examiner* — Daniel Cahn
(74) *Attorney, Agent, or Firm* — Betsy Kingsbury Dowd; BKDowd Law, PC

(57) ABSTRACT

A fastening element for a climbing device configured for fastening to a tree, pole, mast, column, pillar, or like climbing surface includes an outer shell, a concave contact surface formed within the outer shell and a plurality of anchoring nubs. A lattice structure including a plurality of raised ribs may form the contact surface. Each of the plurality of anchoring nubs protrudes from the raised ribs, and one or more may be formed at least partially at an intersection of the lattice structure. The nubs may have a rounded profile and are preferably symmetrically aligned around a longitudinal axis of the fastening element. The plurality of anchoring nubs and the concave contact surface, e.g., a plurality of raised ribs, form an anchoring surface configured to contact a climbing surface, and to anchor the fastening element to the climbing surface, a tree, for example, without damage thereto.

10 Claims, 4 Drawing Sheets

(56) References Cited

U.S. PATENT DOCUMENTS 5,507,362 A * 4/1996 Krueger ..... A62B 35/0068 182/187
6,015,190 A * 1/2000 Wend ..... A47C 4/52 297/16.1
6,095,466 A * 8/2000 Sener ..... A47B 96/027 248/219.4
6,354,400 B1 * 3/2002 Purkayastha ..... E06C 7/08 182/107
6,708,832 B1 * 3/2004 Hannon ..... A47G 7/045 182/187
D549,356 S * 8/2007 Gibson ..... D25/68
7,753,170 B1 * 7/2010 Gibson ..... E06C 7/14 182/107
8,381,876 B1 * 2/2013 Darden ..... A63B 27/02 182/136
2004/0056527 A1 * 3/2004 Lance ..... B60N 2/66 297/463.1
2004/0075037 A1 * 4/2004 Krier ..... A01M 31/02 248/523
2008/0017447 A1 * 1/2008 Sheridan ..... E06C 1/34 182/107
2009/0095569 A1 * 4/2009 Cooper ..... A01M 31/02 182/187
2010/0155178 A1 * 6/2010 Merritt ..... A63B 27/00 182/136
2011/0192680 A1 * 8/2011 Tong ..... A63B 27/00 182/187
2012/0080269 A1 * 4/2012 Furseth ..... B22D 17/22 182/187
2012/0199418 A1 * 8/2012 Priest ..... A01M 31/02 182/129
2013/0187018 A1 * 7/2013 Canfield ..... G09F 17/00 248/219.4
2013/0298379 A1 * 11/2013 Hansen ..... A01K 15/024 29/428
2014/0190767 A1 * 7/2014 Wheelington ..... A01M 31/02 182/129
2014/0291327 A1 * 10/2014 Messerschmidt ..... B65D 25/22 220/475
2015/0160537 A1 * 6/2015 Bier ..... G03B 17/561 248/219.4
2015/0194081 A1 * 7/2015 Peters ..... G09F 17/00 248/218.4

* cited by examiner

CLIMBING DEVICE WITH ANCHORING SURFACE

CROSS-REFERENCE TO RELATED APPLICATIONS

In accordance with the provisions set forth in 35 U.S.C. §§119(a)-(d) and (f), this application claims the benefit of and priority to German Provisional Application No. DE 20 2014 105 291.7 entitled "CLIMBING DEVICE WITH ANCHORING SURFACE," filed Nov. 4, 2014, the entirety of which is hereby incorporated herein by reference thereto.

FIELD OF DISCLOSURE

The present disclosure relates to a climbing device, in particular, to a climbing device with an anchoring surface and method for manufacturing same.

BACKGROUND

European Patent No. EP 1949940 B1, issued on May 18, 2011 to Franz J. Müller (hereinafter, the "Müller EP" patent), the entirety of which is incorporated herein by reference thereto, discloses a device for climbing poles, trees, columns, masts, pillars or the like that includes a fastening element that is fastened to the pole, tree, column, mast, pillar or other climbing object using a tensioning belt. The back side of the fastening element, which serves as a contact surface for contacting the climbing object, is concave and is formed of a non-slip material. The Müller EP patent further discloses that the fastening elements can be detachably positioned for changing climbing routes on, for example, a tree, without causing permanent damage.

SUMMARY

The present disclosure provides a fastening element for a climbing device configured for fastening to a tree, pole, mast, column, pillar, or like climbing surface.

In particular, the present disclosure is directed to a fastening element including an outer shell, a lattice structure formed within the outer shell and a plurality of anchoring nubs. The lattice structure includes a plurality of raised ribs arranged to intersect in a crisscross pattern. Each of the plurality of anchoring nubs is positioned at and protrudes from an intersection of the lattice structure. The nubs have a rounded profile. The plurality of anchoring nubs and the plurality of raised ribs form an anchoring surface configured to contact a climbing surface to which the fastening element is fastened, and to anchor the fastening element to the climbing surface, a tree, for example, without damage thereto.

In one aspect, the outer shell includes a longitudinal midline, which is configured for aligning in a substantially vertical direction to the climbing surface in use. The plurality of anchoring nubs are positioned symmetrically about the longitudinal midline.

In another aspect, the plurality of anchoring nubs may include at least one of two different sizes and two different shapes of anchoring nubs positioned symmetrically about the longitudinal axis.

In an additional aspect, the outer shell includes a longitudinal midline, the midline of the outer shell being configured for aligning in a substantially vertical direction to the climbing surface in use. The plurality of anchoring nubs include outer nubs having a first height and inner nubs having a second height that is less than the first height, the inner nubs being positioned closer toward the midline than the outer nubs.

In yet another aspect, the anchoring surface and the outer shell are curved about the midline for abutting snugly to the contour of the climbing surface.

In still other aspects of a fastening element formed in accordance with the present disclosure, the lattice structure and the plurality of anchoring nubs are integral with the outer shell.

In some aspects, at least the lattice structure and the plurality of anchoring nubs of the fastening element formed in accordance with the present disclosure are formed using injection molding.

Any one or more of the lattice structure including the raised ribs, the plurality of anchoring nubs, and the outer shell may be formed from a plastic material. In some aspects, the plastic includes polyamide.

In various additional aspects a non-skid film or material may be applied to the anchoring surface.

The present disclosure is also directed to a fastening element for a climbing device, the fastening element adapted for mounting a climbing hold thereto. The fastening element is further configured for fastening to a tree, pole, mast, column, pillar, or other climbing surface. The fastening element includes an outer shell and a concave contact surface formed within the outer shell. The concave contact surface is curved around a longitudinal axis of the fastening element for abutting to a climbing surface that is curved around its vertical axis, the concave contact surface being configured for aligning the longitudinal axis to the vertical axis of the climbing surface in use. The fastening element also includes a plurality of anchoring nubs positioned on and protruding from the concave contact surface. The plurality of anchoring nubs and the concave contact surface form an anchoring surface configured to contact the climbing surface to which the fastening element is fastened. The anchoring nubs have a rounded profile for contacting the climbing surface.

In aspects, the plurality of anchoring nubs are positioned symmetrically about the longitudinal axis.

In one aspect, the plurality of anchoring nubs include one of two different sizes and two different shapes of nubs positioned symmetrically about the longitudinal axis.

In additional aspects, the concave contact surface includes a first portion and a second portion positioned along opposing sides of the longitudinal axis. The plurality of anchoring nubs may include outer nubs in each of the first portion and the second portion having a first height, and inner nubs in each of the first portion and the second portion having a second height that is less than the first height, the inner nubs being positioned closer toward the longitudinal axis than the outer nubs.

In yet additional aspects, the rounded profile of at least one of the anchoring nubs for contacting the climbing surface is formed from a protrusion including a portion of one of a substantially spherical shape and a substantially cylindrical shape.

In aspects, the rounded profile of at least one of the anchoring nubs for contacting the climbing surface is formed from a protrusion comprising an arcuate shape.

In additional aspects, the concave contact surface is provided in the form of a lattice structure, which includes a plurality of raised ribs arranged to intersect in a crisscross pattern. At least one of the plurality of anchoring nubs is positioned on and protrudes from at least one of the plurality of raised ribs, the plurality of anchoring nubs and the plurality of raised ribs forming the anchoring surface configured to contact the climbing surface to which the fastening element is fastened.

In still other aspects, at least a portion of one of the plurality of anchoring nubs may be positioned on an intersection of the plurality of the raised ribs.

In still additional aspects, at least a portion of one of the plurality of anchoring nubs may be positioned between intersections of the plurality of the raised ribs.

In other aspects, the concave contact surface and the plurality of anchoring nubs are integral with the outer shell.

In further aspects, the concave contact surface and the plurality of anchoring nubs are formed using injection molding.

The present disclosure is also directed to a fastening element for a climbing device, the fastening element being adapted for mounting a climbing hold thereto. The fastening element is further configured for fastening to a tree, pole, mast, column, pillar, or other climbing surface. The fastening element includes an outer shell, a lattice structure formed within the outer shell, the lattice structure including a plurality of raised ribs arranged to intersect in a crisscross pattern, and a plurality of anchoring nubs, at least one anchoring nub positioned on and protruding from at least one of the plurality of raised ribs. The lattice structure is curved around a longitudinal axis of the fastening element for abutting to a climbing surface that is curved around its vertical axis. The lattice structure is configured for aligning the longitudinal axis to the vertical axis of the climbing surface in use. The plurality of anchoring nubs and the plurality of raised ribs form an anchoring surface configured to contact the climbing surface to which the fastening element is fastened. The plurality of anchoring nubs are positioned substantially symmetrically about the longitudinal axis for stabilizing the fastening element on the climbing surface.

The present disclosure is also directed to a fastening element for a climbing device, the fastening element being adapted for mounting a climbing hold thereto. The fastening element is further configured for fastening to a tree, pole, mast, column, pillar, or other climbing surface. The fastening element includes an outer shell, a concave contact surface, and a plurality of anchoring nubs positioned on and protruding from the concave contact surface. The outer shell surrounds the concave contact surface, the concave contact surface being curved around a longitudinal axis of the fastening element for abutting to a climbing surface that is curved around its vertical axis. The concave contact surface is configured for aligning the longitudinal axis to the vertical axis of the climbing surface in use. The plurality of anchoring nubs and the concave contact surface form an anchoring surface configured to contact the climbing surface to which the fastening element is fastened. The plurality of anchoring nubs are positioned substantially symmetrically about the longitudinal axis for stabilizing the fastening element on the climbing surface.

In addition to the above aspects of the present disclosure, additional aspects, objects, features and advantages will be apparent from the embodiments presented in the following description and in connection with the accompanying drawings.

DETAILED DESCRIPTION

The climbing device disclosed in the Müller EP patent incorporates a fastening element with a concave contact surface formed of a non-slip material for contacting a tree, pole, mast, column, pillar or the like.

Figure 1A:
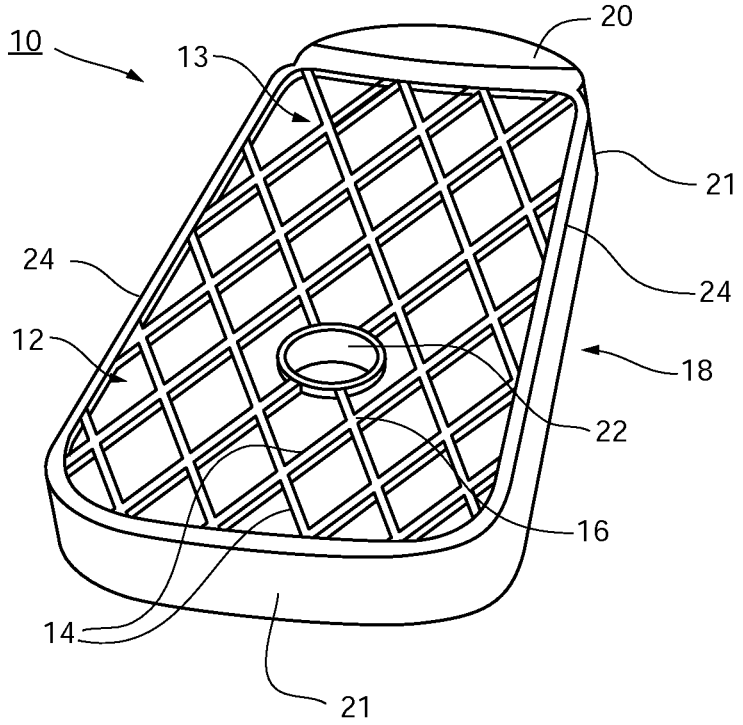
FIG. 1A is a pictorial representation of an embodiment of a rear, side perspective view of a fastening element for a climbing device in accordance with the present disclosure.
Figure 1B:
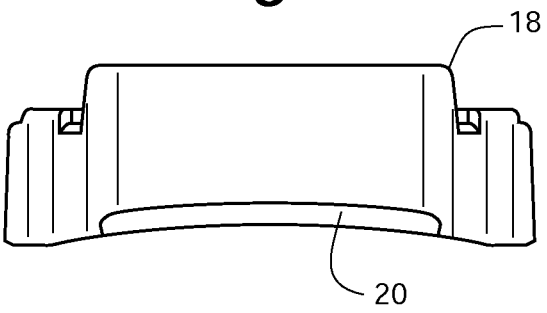
FIG. 1B is a pictorial representation of a top, rear perspective view of the fastening element of FIG. 1A.

Referring to FIGS. 1A and 1B, one embodiment of a fastening element 10 of the present disclosure for attaching to such climbing objects using a tension belt includes a concave contact surface 12 that is preferably formed in the shape of a lattice structure 13, as shown, to lighten the weight of the fastening element. The contacting portion of the lattice structure 13 maintains the overall curved shape for hugging the natural curve of the tree or the like to which it is fastened without damaging the tree's outer surface. The lattice structure 13 is formed by raised ribs 14 formed in a lattice or crisscross pattern, the ribs 14 crossing at a number of intersecting portions 16, wherein the ribs 14 form the contact surface 12.

In the embodiments shown in the present disclosure, the contact surface is provided in the shape of a lattice structure. It should be appreciated that the contact surface of the present disclosure is not limited to the lattice structures shown in the embodiments, which are provided by way of example only. The concave contact surface of the present disclosure may include any structure that can maintain the overall curved shape for hugging the natural curve of the tree or the like to which it is fastened without damaging the tree's outer surface.

Surrounding the concave contact surface 12 is an outer shell 18 which has upper and lower ends 21 and sides 24 connecting between the upper and lower ends 21. When the fastening element 10 is mounted to the climbing surface, the upper and lower ends 21 are oriented substantially horizontally, i.e., perpendicular to a vertical axis of the tree, mast, pole, or other climbing object. The top, or upper end, of the outer shell 18 includes an extending portion 20 that extends beyond the contact surface 12 to form a handle or foot rest. Both the front (exposed) and rear (tree-contacting) surface of the extending portion 20 are designed to be non-slipping. The extending portion 20 thus provides a walking surface to protect the tree or other climbing object from damage from a climber's shoes, and also to protect the shoes of the climber against contamination, for example, from tree sap.

The outer shell 18 also includes an aperture (not shown) which is in alignment with a recess 22 in the contact surface 12. The recess is configured for positioning therein a nut or threaded post, which may be removable, or permanently fixed in place. When assembled for use, climbing holds are preferably attached to the front surface of the fastening element 10 by screwing the climbing hold onto the post positioned in recess 22. Accordingly, different types and shapes of climbing holds can be interchanged as desired to simulate different climbing surfaces and for accommodating different levels of climbing difficulty.

Figure 2A:
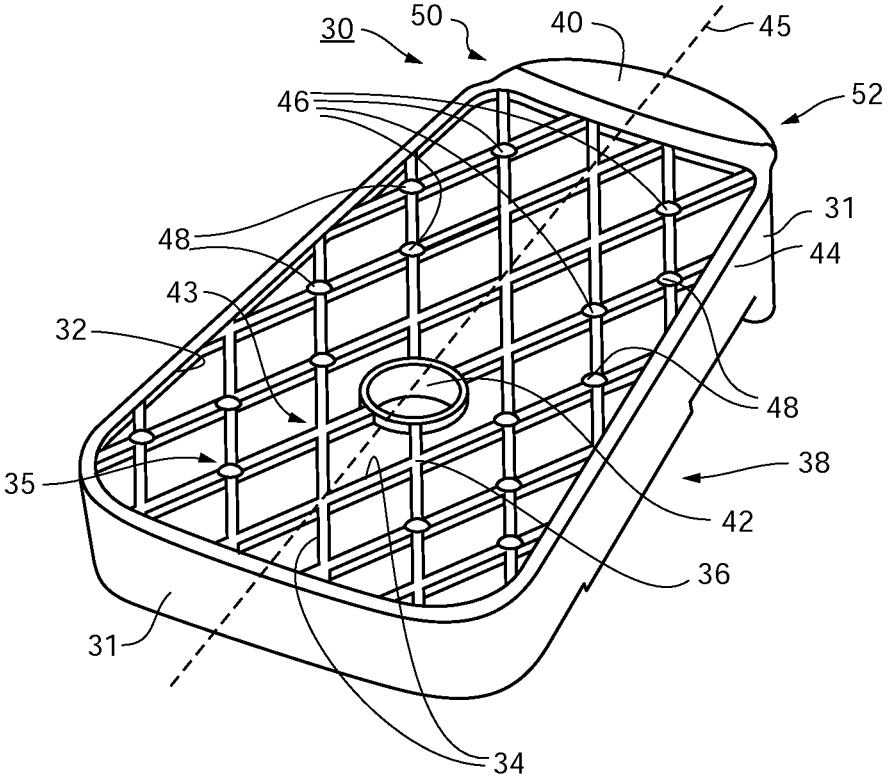
FIG. 2A is a pictorial representation of a rear, side perspective view of another embodiment of a fastening element of a climbing device with an anchoring surface in accordance with the present disclosure.
Figure 2B:
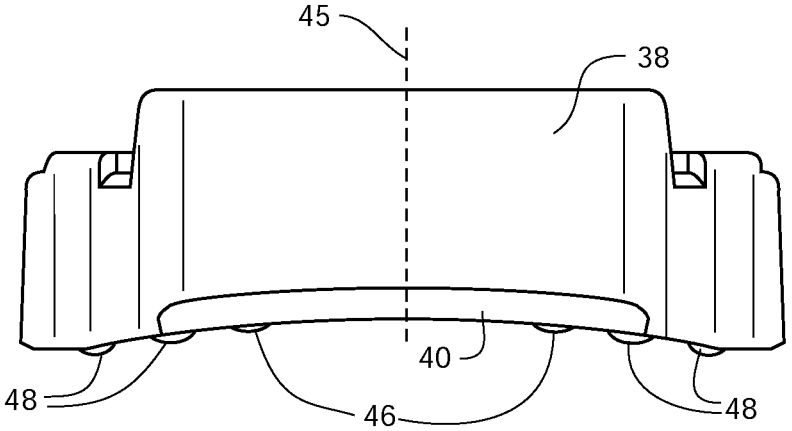
FIG. 2B is a pictorial representation of a top, rear perspective view of the embodiment of the fastening element of FIG. 2A.

Referring to FIGS. 2A and 2B, an embodiment 30 of a fastening element for a climbing device formed in accordance with the present disclosure includes a significantly improved contacting or anchoring surface which helps to anchor the fastening element 30 in position to a tree, pole, mast or the like.

Like the embodiment 10 shown in FIGS. 1A and 1B, the fastening element 30 of FIGS. 2A and 2B is configured for attaching to a pole, tree, column, mast, pillar or other climbing object, for example, by using a tension belt for attaching thereto. The fastening element includes an anchoring surface 35, which includes a curved, e.g., concave contact surface 32, preferably formed with a non-slip surface. The contact surface 32 may be formed from a lattice structure 43 of the present disclosure to lighten the weight of the fastening element. The concave contact surface 32, which is formed by the contacting portion of the lattice structure 43 in the embodiments shown in FIGS. 2A and 2B, is further configured into a curved (concave) shape for hugging the natural curve of the tree or the like to which it is fastened without damaging the tree's outer surface. The lattice structure 43 is formed by raised ribs 34 formed in a lattice or crisscross pattern, the ribs 34 crossing at a number of intersecting portions 36.

The anchoring surface 35 further includes nubs 46, 48, having a rounded profile and protruding from the concave contact surface 32. In the embodiments of FIG. 2A, the nubs 46,48 protrude from portions of the raised ribs 34, those portions preferably including at least some of the intersecting portions 36.

Surrounding the contact surface 32 is an outer shell 38 which has upper and lower ends 31 and sides 44 connecting between the upper and lower ends 31. When the fastening element 30 in the embodiment shown is mounted to the climbing surface, the upper and lower ends 31 are oriented substantially horizontally, i.e., perpendicular to a vertical axis of the tree, mast, pole, or other climbing object. The curved (concave) shape of the lattice structure 43 for hugging the natural curve of the tree is curved around a longitudinal axis 45, preferably, a longitudinal midline 45 of the fastening element 30, which is aligned in use with the vertical axis of the tree. The upper end of the outer shell 38 includes an extending portion 40 that extends beyond the concave contact surface 32 to form a handle or foot rest. Both the front (exposed) and rear (tree-contacting) surface of the extending portion 40 are designed to be non-slipping. The extending portion 40 thus provides a walking surface to protect the tree or other climbing object from damage from a climber's shoes, and also to protect the shoes of the climber against contamination, for example, from tree sap.

The outer shell 38 also includes an aperture (not shown) which is in alignment with a recess 42 in the anchoring surface 35. The recess is configured for positioning therein a nut or threaded post, which may be removable, or permanently fixed in place. When assembled for use, climbing holds are preferably attached to the front surface of the fastening element 30 by screwing the climbing hold onto the post positioned in recess 42. Accordingly, different types and shapes of climbing holds can be interchanged as desired to simulate different climbing surfaces and for accommodating different levels of climbing difficulty.

Referring again to FIGS. 2A and 2B, in some embodiments, the nubs include at least two different heights and/or radii of curvature. In embodiments, outer nubs 48 positioned along the outermost side portions of the lattice structure 43 protrude from intersecting portions 36 at a height higher than the inner nubs 46 positioned more inward, toward the midline 45 of the fastening element 30.

Figure 3:
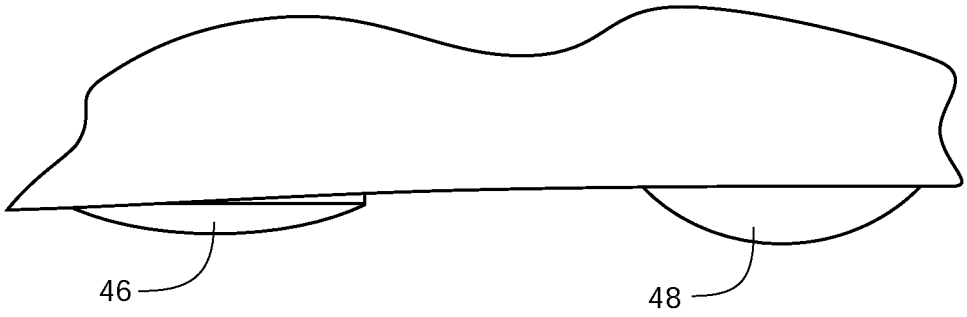
FIG. 3 is a magnified view of a portion of an embodiment of the fastening element of FIGS. 2A and 2B, showing a partial profile view of the rear (anchoring) surface.
Figure 4:
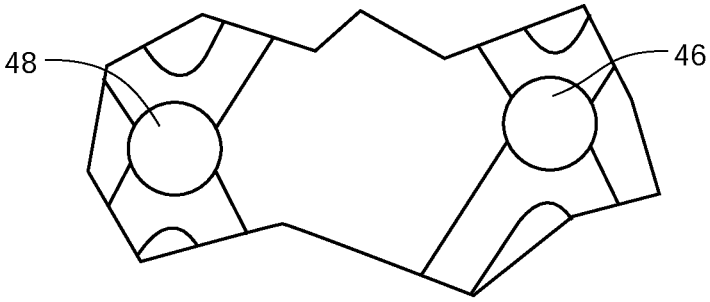
FIG. 4 is an elevation view of a portion of the anchoring surface of the embodiment of the FIG. 3.

For example, as shown in FIGS. 3 and 4, in one embodiment, inner nubs 46 have a height of about 0.5 mm and a radius of curvature of about 13 mm and outer nubs 48 have a height of about 1.0 mm and a radius of curvature of about 7.25 mm. In other embodiments, the height of outer nubs 48 is at least about 1.5 times, preferably at least 2 times, greater than the height of inner nubs 46, and, preferably, the height of inner nubs 46 is at least 0.25 mm. In some embodiments, the radius of curvature of inner nubs 46 is at least about 1.5 times greater than the radius of curvature of outer nubs 48.

It should be appreciated that there are various locations and configurations of the anchoring nubs on a concave contact structure other than those described in the present embodiments that fall within the scope of the present disclosure, providing a contacting surface that enhances anchoring to the curved climbing surfaces of the present disclosure, particularly to the rough surfaces provided by tree bark, while minimizing damage to the climbing surface. The anchoring nubs of the present disclosure are positioned and configured to stabilize the fastening element against a tree, reducing horizontal tilting and minimizing vertical slip. In embodiments, symmetric placement of the anchoring nubs about the longitudinal midline 45 of the fastening element enhances the stabilization features of the fastening element.

Referring again to FIGS. 2A and 2B, the contact surface 32 of the present disclosure may be characterized as including a first portion 50 and a second portion 52 on opposing sides of the longitudinal axis 45. In embodiments, at least one nub will be positioned on either side of the longitudinal axis 45, in other words on each of the first portion 50 and second portion 52. In additional preferred embodiments, the nubs are positioned symmetrically about the longitudinal axis 45, thereby stabilizing the position of the fastening element and reducing horizontal tilt and vertical slippage.

One of skill in the art will appreciate that the anchoring nubs may additionally be of various shapes for minimizing damage to the climbing surface. In preferred embodiments of the present disclosure, the anchoring nubs have rounded profiles for contacting the climbing surfaces. The contacting portion of the anchoring nubs together with the portion of the concave contact surface devoid of anchoring nubs form the anchoring surface of the present disclosure.

In embodiments, the rounded profiles of anchoring nubs, for example, nubs 46, 48 of FIGS. 2A and 2B, are formed from a portion, preferably a low-profile portion, of a substantially spherical shape, which may be described as a low-profile substantially spherical cap.

Figure 5A:
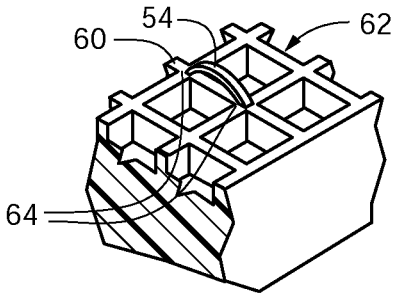
FIGS. 5A-5C are pictorial representations of magnified views of additional embodiments of the fastening element of the present disclosure.
Figure 5B:
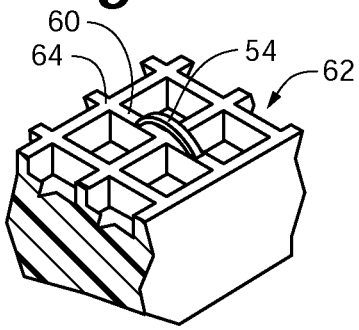
Figure 5C:
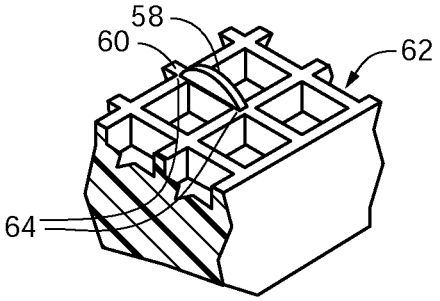

Referring to FIGS. 5A-5C, in embodiments, the rounded profiles of the anchoring nubs are formed from a portion, preferably a low-profile portion, of an arcuate shape, such as an annulus 54, 56, or a slice of a low-profile spherical cap 58 as shown in FIG. 5C.

In embodiments of the present disclosure, wherein the concave contact surface is in the form of a lattice structure, at least a portion of an anchoring nub of a fastening element of the present disclosure is positioned substantially on one of the intersecting portions of the raised ribs.

In embodiments, at least one anchoring nub of a fastening element of the present disclosure may be positioned only on an intersecting portion of the raised ribs.

In other embodiments, at least one anchoring nub may be positioned only on portions of the raised ribs between the intersecting portions.

In still other embodiments, at least one anchoring nub may be positioned on and protrude from both an intersecting portion of the raised ribs and portions of the raised ribs between the intersecting portions.

In embodiments, referring to FIG. 5A, one or both ends of the arcuate shape 54 may protrude from one of the intersecting portions 64 of the lattice structure 62.

In other embodiments, referring to FIG. 5B, portions of the arcuate shape 54 only protrude from portions of raised ribs 60 of a lattice structure 62 that do not include intersecting portions 64.

Referring to FIG. 5C, in embodiments, the rounded profile of at least one of the anchoring nubs is formed from a slice of a low-profile spherical cap 58. The anchoring nub 58 may protrude from one or both of an intersecting portion(s) 64 and from portions of the raised ribs 60 of the lattice structure 62 that are between intersecting portions 64.

Figure 6A:
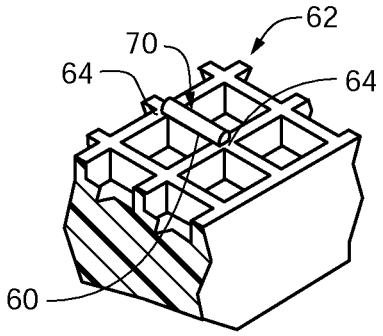
FIGS. 6A-6B are pictorial representations of magnified views of yet additional embodiments of the fastening element of the present disclosure.
Figure 6B:
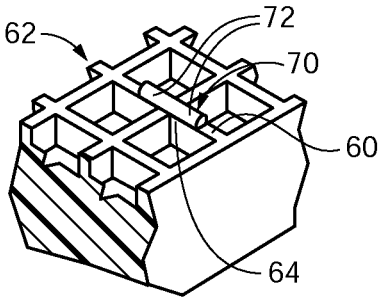

Referring also to FIG. 6A and FIG. 6B, an embodiment of an anchoring nub 70 of the present disclosure is formed from a portion of a substantially cylindrical shape, the protruding portion forming the rounded profile 72 of the elongated anchoring nub. Referring to FIG. 6A, anchoring nub 70 may be located on and protrude from one or more intersecting portions 64 of the lattice structure 62, for example, as well as from the portions of the ribs 60 between the intersecting portions 64. Referring to FIG. 6B, in embodiments, anchoring nub 70 may be located on an intersecting portion 64 and extend beyond the intersecting portion 64 to other portions of the raised ribs 60.

The anchoring surfaces formed in accordance with the present disclosure, including the embodiments shown with the lattice structure, may be formed using injection molding processes known in the art. In some embodiments, the outer shell and concave contact surface, and, in embodiments, the protruding nubs, are integrally formed using injection molding, preferably from a liquid plastic, such as a polyamide plastic. The threaded post or nut for mounting the climbing hold to the fastening element may also be added while the plastic is still warm. Although the contact surface of the present disclosure may have any appropriate structure that can maintain the overall curved shape for hugging the natural curve of the tree or the like to which it is fastened without damaging the tree's outer surface, structures that require less liquid plastic, like the lattice structures provided herein, advantageously produce a final product that is lighter in weight and more ergonomic.

The large abutment surface of the fastening elements formed in accordance with the present disclosure, along with the enhanced anchoring feature provided by the addition of the protruding nubs to a lattice structure as described herein, allow for secure anchoring particularly to rough surfaces provided by trees. In addition, while other types of contact surfaces can cause damage such as indentations in the tree trunk and/or removal of bark from the trees, the addition of the protruding rounded surfaces placed along the lattice ribs of the contact surface of the present disclosure both enhances the anchoring of the fastening element to the tree and minimizes, and preferably prevents, any damage to the tree. The contact surfaces of the present disclosure are equally suitable for attaching to smoother surfaces, such as masts, poles, pillars, columns and so on.

While the methods and system of the present disclosure have been particularly shown and described with reference to specific embodiments, it should be apparent to those skilled in the art that the foregoing is illustrative only and not limiting, having been presented by way of example only. In addition, various changes in form and detail may be made therein without departing from the spirit and scope of the disclosure. Therefore, numerous other embodiments are contemplated as falling within the scope of the present methods and system as defined by the accompanying claims and equivalents thereto.

What is claimed is:

1. A fastening element for a climbing device, the fastening element adapted for mounting a climbing hold thereto, and for fastening to a climbing surface that is curved around a vertical axis, the fastening element comprising:

an outer shell;

a concave contact surface, the concave contact surface formed within the outer shell, the concave contact surface being curved around a longitudinal axis of the fastening element for abutting to the climbing surface that is curved around the vertical axis, the concave contact surface being configured for aligning the longitudinal axis to the vertical axis of the climbing surface in use and for contacting the climbing surface to which the fastening element is fastened, wherein the concave contact surface further comprises a lattice structure, the lattice structure comprising a plurality of raised ribs arranged to intersect in a crisscross pattern; and a plurality of anchoring nubs, each of the nubs positioned on and protruding from one of the plurality of raised ribs, the plurality of anchoring nubs and the plurality of raised ribs forming the concave contact surface configured to contact the climbing surface and to anchor the fastening element thereto; and wherein each of the anchoring nubs has a rounded profile for contacting the climbing surface.

2. The fastening element of claim 1, wherein the plurality of anchoring nubs are positioned symmetrically about the longitudinal axis.

3. The fastening element of claim 2, wherein the plurality of anchoring nubs include one of two different sizes and two different shapes of anchoring nubs positioned symmetrically about the longitudinal axis.

4. The fastening element of claim 1, wherein the concave contact surface includes a first portion and a second portion positioned along opposing sides of the longitudinal axis, the plurality of anchoring nubs including outer nubs in each of the first portion and the second portion having a first height, and inner nubs in each of the first portion and the second portion having a second height that is less than the first height, the inner nubs being positioned closer toward the longitudinal axis than the outer nubs.

5. The fastening element of claim 1, wherein the rounded profile of at least one of the anchoring nubs for contacting the climbing surface is formed from a protrusion comprising a portion of one of a substantially spherical shape and a substantially cylindrical shape.

6. The fastening element of claim 1, wherein the rounded profile of at least one of the anchoring nubs for contacting the climbing surface is formed from a protrusion comprising an arcuate shape.

7. The fastening element of claim 1, wherein each of the plurality of anchoring nubs is positioned on an intersection of the plurality of the raised ribs.

8. The fastening element of claim 1, wherein at least a portion of one of the plurality of anchoring nubs is positioned between intersections of the plurality of the raised ribs.

9. The fastening element of claim 1, wherein the concave contact surface including the plurality of raised ribs and the plurality of anchoring nubs is integral with the outer shell.

10. The fastening element of claim 1, wherein the concave contact surface and the plurality of anchoring nubs are injection-molded structures.

* * * * *